US007135075B2

(12) United States Patent
Buchheit et al.

(10) Patent No.: US 7,135,075 B2
(45) Date of Patent: Nov. 14, 2006

(54) CORROSION RESISTANT COATING WITH SELF-HEALING CHARACTERISTICS

(75) Inventors: Rudolph G. Buchheit, Columbus, OH (US); Hong Guan, Hilliard, OH (US); Valerie N. Laget, Le Havre (FR)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 10/761,077

(22) Filed: Jan. 20, 2004

(65) Prior Publication Data

US 2004/0216637 A1 Nov. 4, 2004

Related U.S. Application Data

(60) Provisional application No. 60/441,498, filed on Jan. 21, 2003.

(51) Int. Cl.
*C23C 22/06* (2006.01)
*C23C 22/40* (2006.01)

(52) U.S. Cl. ..... 148/243; 106/14.11; 106/14.12; 106/14.21; 148/253; 148/261; 148/262; 148/268; 148/269; 148/275; 427/427; 427/428.11; 427/435; 427/436; 428/469; 428/472; 428/472.2; 428/472.3

(58) Field of Classification Search ..... 106/14.11, 106/14.12, 14.14, 14.21; 148/243, 253, 261, 148/262, 269, 275, 268; 427/427, 428.11, 427/435, 436; 428/469, 472, 472.2, 472.3
See application file for complete search history.

(56) References Cited

U.S. PATENT DOCUMENTS

| | | | | |
|---|---|---|---|---|
| 4,036,667 | A * | 7/1977 | Simon | 148/268 |
| 4,873,011 | A | 10/1989 | Jung et al. | 252/75 |
| 5,520,750 | A | 5/1996 | Riley | 148/261 |
| 5,743,971 | A | 4/1998 | Inoue et al. | 148/247 |
| 5,866,652 | A * | 2/1999 | Hager et al. | 524/70 |
| 5,886,652 | A | 3/1999 | Adachi et al. | 341/67 |
| 5,938,861 | A | 8/1999 | Inoue et al. | 148/247 |
| 5,954,893 | A | 9/1999 | Baldwin et al. | 148/272 |
| 5,985,047 | A | 11/1999 | Buxton et al. | 148/247 |
| 6,027,579 | A | 2/2000 | Das et al. | 148/256 |
| 6,077,885 | A * | 6/2000 | Hager et al. | 523/445 |
| 6,287,394 | B1 * | 9/2001 | Buxton et al. | 148/247 |
| 6,315,823 | B1 * | 11/2001 | Dolan | 106/14.21 |
| 6,468,364 | B1 * | 10/2002 | Marecic | 148/253 |
| 6,692,583 | B1 * | 2/2004 | Bengston et al. | 148/261 |

OTHER PUBLICATIONS

Derwent Abstract No. 1993-271395, abstract of Soviet Union Patent Specification No. 1758091 (Aug. 1992).*

Akiyama et al., "The Influence of Dichromate Ions on Aluminum Dissolution Kinetics in Artificial Crevice Electrode Cells", Journal of The Electrochemical Society, 146 (11), 1999, pp. 4095-4100, no month.

Buchheit et al., "Active Corrosion Protection in Ce-Modified Hydrotalcite Conversion Coatings", Corrosion, vol. 58, No. 1, Jan. 2002, pp. 3-14.

Buchheit et al., "Active corrosion protection and corrosion sensing in chromate-free organic coatings", Progress in Organic Coatings, 47, 2003, pp. 174-185, no month.

Clark et al., "A Galvanic Corrosion Approach to Investigating Chromate Effects on Aluminum Alloy 2024-T3", Journal of The Electrochemical Society, 149 (5), 2002, pp. B179-B185, no month.

Clark et al., "Inhibition of Corrosion-Related Reduction Processes via Chromium Monolayer Formation", Journal of The Electrochemical Society, 149 (9), 2002, pp. B379-B386, no month.

Cohen, "Replacements for Chromium Pretreatments on Aluminum", Corrosion, vol. 51, No. 1, Jan. 1995, pp. 71-78, no month.

Gallaccio et al., "Effects of Heating Chromate Conversion Coatings", Metal Finishing, Aug. 1966, pp. 50-54.

Glass, "Recent Radioactive Tracer", Materials Protection, Jul. 1968, pp. 26-30.

Hagans et al., "Influence of Metallurgy on the Protective Mechanism of Chromium,-Based Conversion Coatings on Aluminum-Copper Alloys", Surface and Interface Analysis, vol. 21, 1994, pp. 65-78, no month.

Hinton, "Corrosion Prevention and Chromates the End of an Era?", Metal Finishing, Sep. 1991, pp. 55-61, no month.

Hinton, "Corrosion Prevention and Chromates, the End of an Era?", Metal Finishing, Oct. 1991, pp. 15-20.

Ilevbare et al., "Mass Transport Limited Oxygen Reduction Kinetics on Chromate Conversion Coated Al-Cu, Al-Cu-Mg and Ak-Cu-Mn-Fe Intermetallic Compounds.", Electrochemical Society Proceeding, vol. 99-27, 1999, pp. 269-279, no month.

Ilevbare et al., Mass-Transport-Limited Oxygen Reduction Reaction on AA2024-T3 and Selected Intermetallic Compounds in Chromate-Containing Solutions, Corrosion, Feb. 2001, pp. 134-152.

(Continued)

*Primary Examiner*—Anthony J. Green
(74) *Attorney, Agent, or Firm*—Standley Law Group LLP

(57) ABSTRACT

An aqueous solution for depositing an inorganic corrosion resistant coating on a metal substrate is disclosed. The aqueous solution comprises a film-forming agent, a supplemental anion, and a substrate activator. The film-forming agent is a vanadate salt that forms the corrosion resistant coating. The supplemental anion accelerates the rate at which the corrosion resistant coating is formed. The substrate activator serves to remove any existing oxides from the metal substrate prior to the formation of the corrosion resistant coating. The present invention additionally covers objects so coated and methods of application.

19 Claims, 6 Drawing Sheets
(1 of 6 Drawing Sheet(s) Filed in Color)

OTHER PUBLICATIONS

Ilevbare et al., Oxygen Reduction Reaction Kinetics on Chromate Conversion Coated Al-Cu, Al-Cu-Mg, and Al-Cu-Mn-Fe Intermetallic Compounds, Journal of The Electrochemical Society, 148 (5), 2001, pp. B196-B207, no month.
Kaesche, "Pitting Corrosion of Aluminum, and Intergranular Corrosion of Aluminum Alloys", International Corrosion Conference, 1974, pp. 516-525, no month.
Katzman et al., "Corrosion-Protective Chromate Coatings on Aluminum", Applications of Surface Science 2, 1979, pp. 416-432, no month.
Kendig et al., "Corrosion Inhibition of Al and Al Alloys by Hexavalent Cr Compounds—A Mechanistic Overview", 2000, pp. 1-31, no month.
Kendig et al., "Corrosion Inhibition of Aluminum and Aluminum Alloys by Soluble Chromates, Chromate Coatings, and Chromate-Free Coatings", Corrosion, vol. 59, No. 5, May 2003, pp. 379-400.
Laget et al., "Thermal Stability and Aging Characteristics of Chromate Conversion Coatings on Aluminum Alloy 2024-T3", Electrochemical Society Proceeding, vol. 99-26, 2000, pp. 173-182, no month.
Laget et al., "Dehydration-Induced Loss of Corrosion Protection Properties in Chromate Conversion Coatings of Aluminum Alloy 2024-T3", Journal of The Electrochemical Society, 150 (9), 2003, pp. B425-B432, no month.
Newhard, "Conversion Coatings for Aluminum", Metal Finishings, Jul. 1972, pp. 49-53.
Newhard, "Conversion Coatings for Aluminum", Metal Finishings, Aug. 1972, pp. 66-69.
Osborne et al., "Testing and evaluation of nonchromated coating systems for aerospace applications", Progress in Organic Coatings, 41, 2001, pp. 217-225.
Osborne, "Observations on chromate conversion coatings from a sol-gel-perspective", Progress in Organic Coatings, 41, 2001, pp. 280-286, no month.
Pearlstein et al., "Heat Resistant Chromate Conversion Coatings", Plating, Apr. 1968, pp. 345-346.
Pride et al., "Metastable Pitting of Aluminum and Criteria for the Transition to Stable Pit Growth", J. Electrochem. Soc., vol. 141, No. 11, Nov. 1994, pp. 3028-3040.
Sehgal et al., "Pitting in Aluminum Thin Films. Supersaturation and Effects of Dichromate Ions", J. Electrochem. Soc., vol. 145, No. 8, Aug. 1998, pp. 2834-2840.
Twite et al., "Review of alternatives to chromate for corrosion protection of aluminum aerospace alloys", Progress in Organic Coatings, 33, 1998, pp. 91-100, no month.
van Ooij et al., "Silane Based Chromate Replacements for Corrosion Control, Paint Adhesion, and Rubber Bonding", Surface Engineering, vol. 16, No. 5, 2000, pp. 386-396, no month.
van Ooij et al., "Electrochemical Impedance Spectroscopy of Bis-[Triethoxysilypropyl]Tetrasulfide on Al 2024-T3 Substrates", Corrosion, vol. 57, No. 5, May 2001, pp. 413-427.
Wernick et al., "Chapter 5 Chemical Conversion Coatings", Surface Treatment and Finishing Aluminum Alloys, 1987, pp. 220-288, no month.
Xia et al., " Chemistry of a Chromate Conversion Coating on Aluminum Alloy AA2024-T3 Probed by Vibrational Spectroscopy", J. Electrochem. Soc., vol. 145, No. 9, Sep. 1998, pp. 3083-3089.
Xia et al., "Structure and Function of Ferricyanide in the Formation of Chromate Conversion Coatings on Aluminum Aircraft Alloy", Journal of The Electrochemical Society, 146 (10), 1999, pp. 3696-3701, no month.
Zhang et al., "Characterization of Chromate Conversion Coating Formation and Breakdown Using Electrode Arrays", Journal of The Electrochemical Society, 149 (8), 2002, pp. B357-B365, no month.
Zhao et al., "Corrosion Protection of Untreated AA-2024-T3 in Chloride Solution by a Chromate Conversion Coating Monitored with Raman Spectroscopy", J. Electrochem. Soc., vol. 145, No. 7, Jul. 1998, pp. 2258-2264.

* cited by examiner

CORROSION RESISTANT COATING WITH SELF-HEALING CHARACTERISTICS

TECHNICAL FIELD OF THE INVENTION

This invention relates generally to metal finishes. More specifically, the present invention relates to surface pre-treatments, otherwise known as conversion coatings applied to enhance corrosion resistance and paintability of metallic articles. A distinctive component of the corrosion protection provided by this coating is its ability to release an inhibitor into an attacking electrolyte to self-heal minor amounts of mechanical or chemical damage in the conversion coating formed by the treatment.

BACKGROUND OF THE INVENTION

Chromates are powerful inhibitors of anodic and cathodic components of corrosion reactions. However, as chromates are dangerous pollutants and toxins, there is a great desire to eliminate their use in industrial surface finishing processes such as surface conversion. To successfully replace chromated surface finishing processes with functional attributes it is essential to understand how chromate works. The essential attributes of Cr chemistry leading to corrosion protection are summarized as follows.

On metal surfaces, particularly aluminum alloys, chromates are readily adsorbed and reduced to hydroxylated $Cr^{3+}$. This surface complex appears to be exceptionally inert and strongly inhibits electron transfer reactions including oxygen reduction and further chromate reduction. The ability to inhibit oxygen reduction is a main component of corrosion protection afforded by chromate. Sub-part per million concentrations of chromate have been observed to reduce the oxygen reduction reaction rate to low levels. This potent inhibition process is made even more powerful because the adsorption and reduction reaction occurs on many different metals. This behavior likely accounts for the remarkable effectiveness of chromate passivation on various different metals and on microstructurally complex Al alloys.

Chromates also inhibit anodic reactions. Normally, resistance to pitting is only detected in environments where the chromate-to-chloride ratio exceeds 0.1. On this basis it might be argued that anodic inhibition is not as potent as cathodic inhibition. Nonetheless, it is believed to be important overall component of chromate corrosion protection.

Chromate conversion coatings (CCCS) provide protection to underlying substrates and intercoat adhesion in coating systems. Their most intriguing attribute is their ability to store and release a chromate corrosion inhibitor. While this attribute may lead to strongly inhibiting coatings, it is a temporary effect that is lost as the coating dehydrates under the influence of heat or dry environments. Long-term retention of self-healing characteristics represents an opportunity to improve Cr-free coating system performance.

Chromates are "suicidal inhibitors" in the sense that as they react with a metal surface, they stifle further electrochemical reactions; including the one that leads to the continued formation of the inhibiting film itself. For this reason, chromates by themselves do not lead to the formation of robust conversion coatings. To form CCCs, supplemental ingredients must be added to an aqueous solution to make it a coating bath. Supplemental ingredients include activators like fluorides, and accelerators like ferricyanide. In Al alloys, fluoride activates the surface by initially dissolving the protective oxide. This allows chromate reduction to proceed long enough for a three-dimensional film to form. Ferricyanide acts as a redox mediator and accelerates the rate at which the chromate reduction-aluminum oxidation redox couple proceeds. Once $Cr^{3+}$ is formed near the Al surface, it hydrolyzes, polymerizes and condenses according to a sol-gel mechanism. This forms a $Cr(OH)_3$ "backbone" consisting of linked octahedral units of hydroxylated $Cr^{3+}$, which comprise the CCC film. As this backbone forms, chromates are adsorbed onto it. Chromate adsorption onto the backbone is reversible for a time, which leads to the famous self-healing effect when the CCC is contacted by an attacking electrolyte. In self-healing, chromates stored at adsorbed sites on the backbone are released into solution where they may be transported to defect sites to stifle further corrosion by the mechanisms discussed earlier. In this way, CCCs are able to store and release a potent corrosion inhibitor for self-protection.

CCCs are hydrated gels whose properties change as water is lost. Once removed from solution CCCs dehydrate. As water is lost, the backbone consolidates leading to shrinkage-cracking, immobilization of chromates, and loss of the self-healing characteristic and overall corrosion resistance. This process occurs over a matter of days in ambient indoor environments, and is dramatically accelerated by exposure to elevated temperatures or low humidity.

For aluminum alloys, it should be noted that chromate conversion coatings are often considered as a single process suitable for all alloys under all processing conditions. In reality, this is not the case since different formulations are used for different applications. Indeed there is no single, published database comparing the performance of chromate conversion coatings on a range of alloys cast or wrought in a range of tempers. The available performance data places a strong emphasis on sheet 2024-T3 with some data reported for 7075-T6 and 6061-T6 substrates.

It should also be noted that the conversion coating is a multi-step process usually involving both cleaning and deoxidizing/desmutting prior to conversion coating. Over many years, the metal finishing industry has optimized the pre-treatment steps for chromate conversion coating and it is not surprising that a chromate-based deoxidizer is often used since it sets up a surface more amenable to chromate conversion coating than other deoxidizers. Chromate alternatives may have their own requirements for pre-treatment, which may not be the same as the current process steps. These two factors should be taken into account when considering the use of chromate conversion coating replacements.

It is therefore a goal of the present invention to provide a chromate-free coating having the same ease of applicability and similar performance characteristics as chromate conversion coatings including the ability to self-heal. Furthermore, it is a goal of the present invention to provide a chromate-free coating process that can be carried out within the established pre-treatment procedures used in industry.

The prospect of replacing chromate conversion coatings has brought with it considerable investigation of potential alternatives based on a broad range of chemistries. Furthermore within each chemical category there is the potential for a broad range of formulations most of which will not yield a viable industrial process due to processing or performance limitations. Several reviews of the subject exist. These reviews show that a very broad range of approaches and chemistries has been considered. Several commercial Cr-free conversion coating technologies, and a somewhat greater number of primer coating technologies are available. n terms of chemistry, the large number of reports and patents related to Ce indicate that it is an excellent inhibitor of metal corrosion. Among non-Cr corrosion inhibitors, the mechanistic understanding of Ce inhibition is clearly the most developed. Other notable transition metal inhibitors are Mn, Co, V, W, Mo, and Fe. These are distinguished by the fact that they can strongly inhibit corrosion under the proper conditions and have been cited in many Cr-free coating patents. Sufficient intercoat adhesion is essential for durable coating systems. In recent years, silane coupling agents, and functionally graded or tailored sol-gel coatings have been explored for these purposes with some measure of success. These systems derive high adhesion from covalent bonding with the metal substrate and organic topcoats.

A comprehensive review of all CCC alternatives is difficult due to the range and quality of performance data for these processes, and because different processes are targeted towards different segments of the metal finishing industry that each have different performance requirements. Some comparative studies have been carried out and are a good source of performance data, but they do not include all the processes described herein. Furthermore, developments in chromate alternatives are progressing rapidly and results presented in comparative reports may not reflect the current performance of processes.

Chromate conversion coatings are used in a broad range of applications in industry, especially in aluminum finishing. An equally broad range of alternatives has been explored to meet the performance and processing requirements of different sectors of industry (Table 1). Currently, several chromate-alternatives have gained acceptance in specific sectors of the market. These markets can be divided into those that require protection in an unpainted state and those that require performance under paint. For the latter category, many alternatives demonstrate good performance characteristics. The aerospace industry falls into the former case and a drop-in replacement still does not exist in this high performance end of the market, which has very high standards for corrosion resistance of the unpainted conversion coated surface in the neutral salt spray test.

TABLE 1

Major Classes of Chromate Alternatives

| Coating Type | Industry Sector | Status[1] |
|---|---|---|
| Titanium and Zirconium | Sheet stock for canning, | Mature |
| Fluorocomplexes | Automotive | Developing |
| Cerium-based | Architectural | Developing |
| | Aerospace | Evaluation |
| Co-based | Marine | Developing |
| | Auto | Developing |
| | Aerospace | Evaluation |
| Mo-based | Sn and Galvanized Product | Developing |
| Hydrotalcites | Aerospace | Evaluation |
| Mn-based | Some Sheet Product, | Developing |
| | Aerospace | Evaluation |
| Boehmite Coatings | Aerospace | Evaluation |
| Silane Coatings | Auto | Developing |
| Conducting Polymers | Ferrous Metals | Evaluation |
| Self Assembled Monolayers | Auto Al/Mg Alloys | Developing |

[1]Mature: in the industry for a number of years; Developing: may be introduced soon; Evaluation: still undergoing trials.

Table 1 lists the major types of chromate alternatives in use or under development and the industries that are currently targeted by the manufacturers of these products. The majority of these processes are still under development with fluorozirconoic and fluorotitanic acid coatings being the most mature of the replacement technologies, with products in the market for a number of years.

The present invention provides a general approach for the formation of a corrosion resistant coating with self-healing characteristics based on contacting metal surfaces with aqueous solutions whose primary film-forming agent is vanadate.

SUMMARY OF THE INVENTION

The present invention covers the chemistry and methods of application for an inorganic corrosion resistant coating. The coating may be applied to aluminum, iron, zinc, magnesium, cadmium and their alloys. The coating may also be appropriate for use with other less widely used metals and alloys.

The coating chemistry comprises a film forming agent, a secondary transition metal oxoanion, and a substrate activator. Coating formation is carried out in an aqueous solutions whose pH can range from 1 to 6 with the best results obtained when the solution pH is between 1.5 and 2.0 The coating solution is typically acidified with nitric acid. The film-forming agent is one or more vanadate salts. The use of sodium metavanadate ($NaVO_3$) is considered typical. Vanadate salt concentrations range from 10 to 150 mM. Potassium ferricyanide, or some other transition metal anion or anions is added in 1 to 75 mM concentration, which improves coating formation characteristics and corrosion resistance of the coatings described in this invention. To further promote vanadate film formation, fluoride ion is added to the bath at concentrations ranging from 1 to 50 mM. The pH of the coating bath may be adjusted with nitric acid. In the case of other alloy substrates such as ferrous or magnesium alloys, the low pH of the coating bath may be sufficient to activate the surface and fluoride additions may not be necessary.

Coating can be carried out by contacting a surface with an aqueous solution of the proper mixture and concentration of reagents as discussed above. Coatings with useful properties form in a matter of seconds, but coatings with optimum corrosion resistance in electrochemical testing form in about 3 minutes. In situations where the surface is too large for immersion, coatings may be formed by spray application.

Coatings formed by this method possess good corrosion resistance. In electrochemical and exposure testing corrosion resistance of vanadium coatings approaches that of chromate conversion coatings, which are in widespread use currently.

An aqueous solution for depositing an inorganic corrosion resistant coating with self-healing properties on a metal substrate of the present invention comprises (1) a film-forming agent comprising a vanadate salt that forms the corrosion resistant coating at a first rate; (2) a supplemental soluble metal anion that accelerates the first rate thereby causing the corrosion resistant coating to form faster than the first rate; and (3) a substrate activator adapted to remove oxides on the metal substrate prior to formation of the corrosion resistant coating.

It is preferred that the aqueous solution has a pH in the range of from about 1.0 to about 6.0. It is further preferred that the metal substrate comprises a metal selected from the group consisting of ferrous metals and non-ferrous metals. It is even more preferred that the metal substrate comprise a metal selected from the group consisting of aluminum, iron, zinc, magnesium, cadmium, and alloys thereof.

It is preferred that the film-forming agent is present in a concentration of from about 5 to about 150 mM.

It is further preferred that the supplemental soluble metal anion is selected from the group consisting of ferricyanide, anions of iron, anions of molybdenum, anions of tungsten, anions of manganese, anions of boron, and anions of phosphorous. It is preferred that the supplemental soluble metal anion is present in a concentration of from about 1 to about 75 mM.

It is also preferred that the substrate activator is selected form the group consisting of chloride salts and fluoride salts. Additionally, it is preferred that the substrate activator is present in a concentration of from about 1 to about 50 mM.

The present invention also includes metal objects coated with the aqueous solution described above. The aqueous solution may be applied to the metal object by a variety of processes. It is preferred that the process is selected from the group consisting of immersion of the metal object in a bath of the aqueous solution, spraying the aqueous solution on the metal object, and rolling the aqueous solution on the metal object.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT(S)

In accordance with the foregoing summary, the following presents a detailed description of the preferred embodiment of the invention that is currently considered to be the best mode.

Vanadate conversion coating (VCC) is carried out in a manner analogous to chromate conversion coating (CCC). Coatings were formed on 50 mm×100 mm×2 mm 2024-T3 sheet stock. Prior to coating, all samples were washed with an alkaline detergent, degreased in a sodium silicate ($NaSiO_3$)/sodium carbonate ($Na_2CO_3$) solution, then deoxidized in a nitric acid ($HNO_3$)/sodium bromate ($NaBrO_3$)-based solution. Samples were rinsed in overflowing deionized water between each step. VCC coatings were formed by immersion in a bath containing a mixture of sodium vanadium oxide $NaVO_3$ (10 to 100 mM), accelerator $K_3Fe(CN)_6$ (3 mM), and activator NaF (2 mM) at room temperature. The bath pH was adjusted using concentrated $HNO_3$. After the coatings were formed, the coated surfaces were rinsed in overflowing deionized water, then soaked for a further 3 minutes in deionized water. Coatings were air-dried and aged for 24 hours before any further handling or analysis.

Figure 1A:
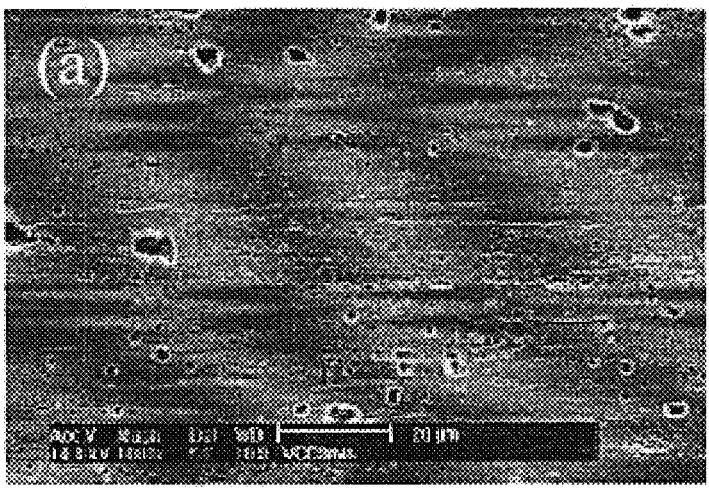
FIG. 1*a* is a scanning electron micrograph (SEM) of a vanadate coating of the present invention at a magnification of 1,000×.
Figure 1B:
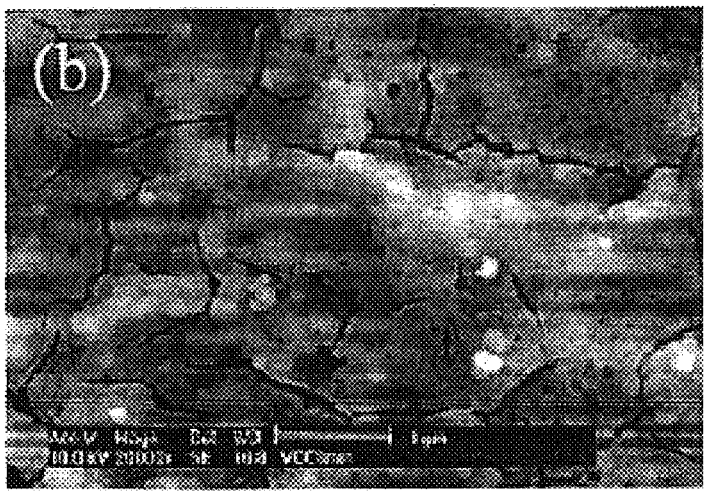
FIG. 1*b* is a SEM of the vanadate coating of the present invention at a magnification of 20,000×.
Figure 1C:
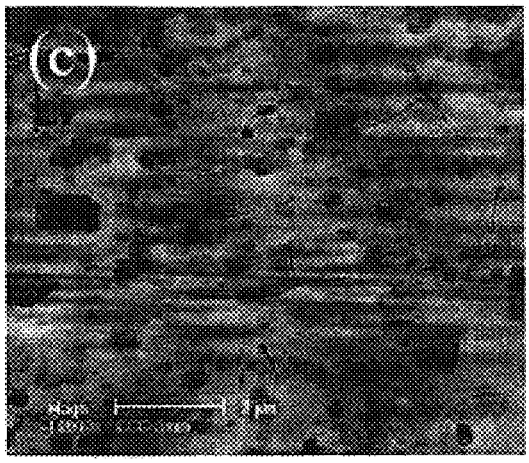
FIG. 1*c* is a SEM of a chromate conversion coating of the prior art at a magnification of 10,000×.
Figure 1D:
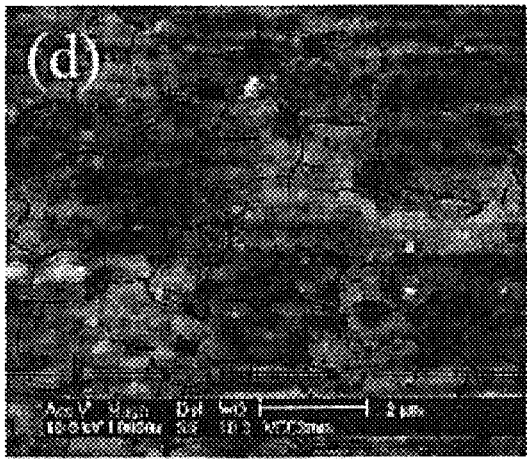
FIG. 1*d* is a SEM of the vanadate coating of the present invention at the same magnification level as shown in FIG. 1*c*.

VCCs formed on 2024-T3 by a 3-minute immersion in a 100 mM $NaVO_3$, 3 mM $K_3Fe(CN)_6$ and 2 mM NaF at pH 1.7 M bath exhibited a yellow integral surface layer that appeared continuous across the sample surface. FIGS. 1*a*, 1*b*, and 1*d* show scanning electron micrographs of such a VCC at several different magnifications. FIG. 1*c* is a micrograph of a chromium chromate conversion coating formed in a ferricyanide-accelerated bath at the same magnification level as FIG. 1*d*, for comparison. In terms of coating morphology, VCCs appear to be quite similar to CCCs. The VCC forms in and over pits that develop during degreasing and deoxidation treatments. The coating forms over intermetallic particles and inclusions present in the alloy. The coating itself contains small nodular features. There is no faceting or structure to suggest a crystalline component to the coating. In fact, no crystalline compounds were detected by x-ray diffraction of the coated surface. The VCC does contain a network of cracks that are similar to the shrinkage cracks, which are known to develop in CCCs. It is likely that the cracks in the VCC develop due to coating dehydration; analogous to the situation with CCCs.

Figure 2A:
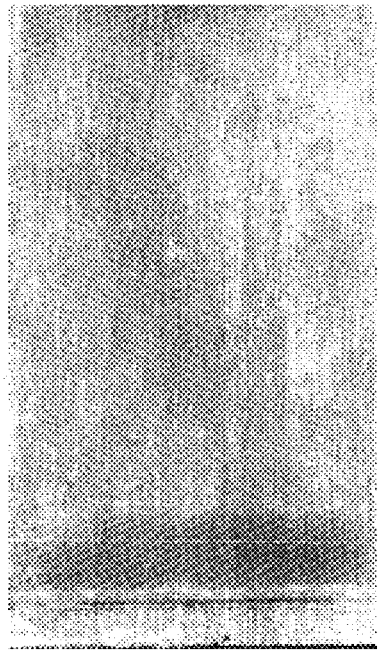
FIG. 2*a* is a photograph of a vanadate conversion coating (VCC) on an approximately 50×100 mm coupon of 2024-T3 in an as -coated condition.
Figure 2B:
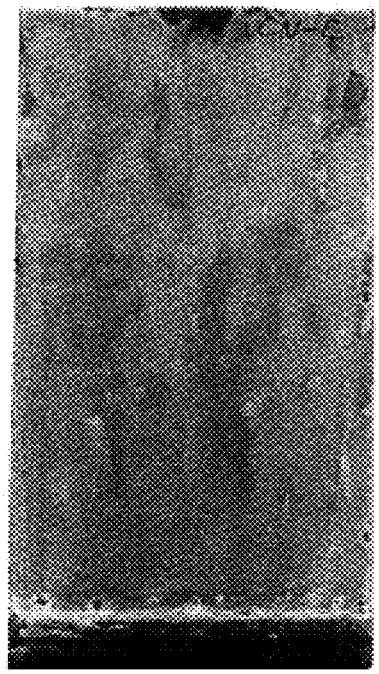
FIG. 2*b* is a photograph of the VCC on 2024-T3 after 168 hours of salt spray exposure.
Figure 2C:
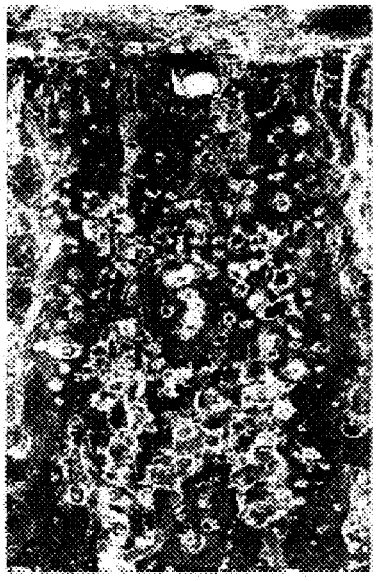
FIG. 2C is a photograph of bare 2024-T3 after 168 hours of salt spray exposure. Coupon sizes are approximately 50×100 mm.

To evaluate overall corrosion resistance of VCCs, coated 2024-T3 panels were subjected to salt spray testing, which was carried out according to ASTM B 117. Six samples of coated 2024-T3 were tested. No pitting damage was found on any of the samples after 24 hours of exposure. A few pits appeared on four of the sample surfaces in 72 hours, but no further pitting damage developed up to the end of the test at 168 hours. FIG. 2*a* shows a VCC on 2024-T3 before exposure. FIG. 2*b* shows a VCC on 2024-T3 after exposure. An un-coated 2024-T3 control panel is shown in FIG. 2*c* for comparison. The difference in the amount of corrosion observed on the control sample and the coated sample is a visual indication of the extent of corrosion protection provided by VCCs.

Figure 3:
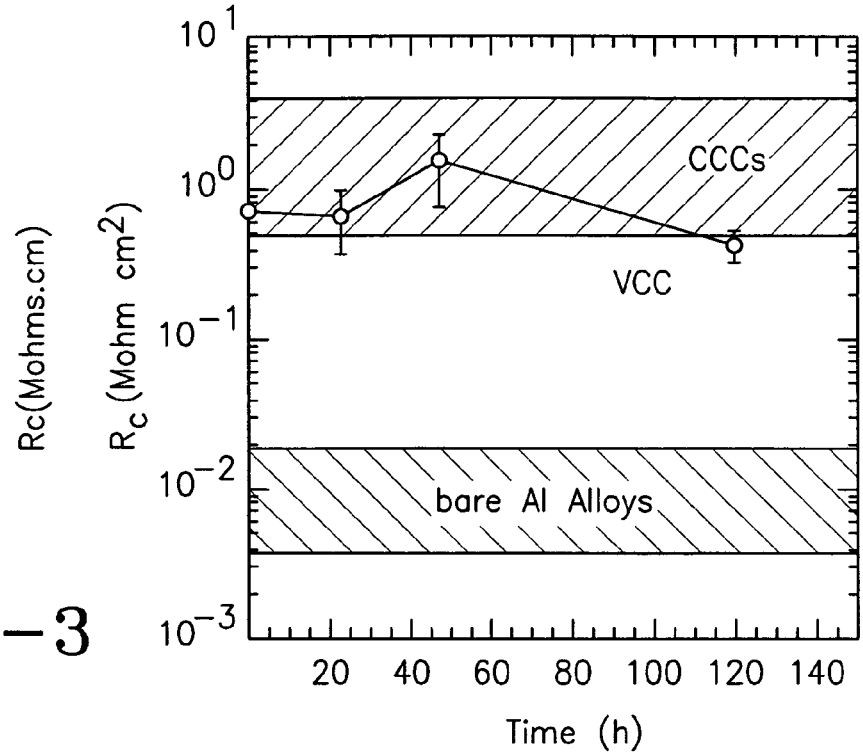
FIG. 3 is a graph of VCC corrosion resistance as determined by EIS testing. $R_c$ values, indicated by data points scatter bands, were determined after exposure to aerated 0.5M NaCl solution. The upper band indicates the range of $R_c$ values measured for CCCs in this environment. The lower band indicates the range in $R_c$ values measured for uncoated Al alloys.

Electrochemical impedance spectroscopy was used to quantitatively characterize the corrosion resistance of VCCs. Coated 2024-T3 samples were exposed to aerated 0.5M NaCl solution using a flat cell exposing 1 $cm^2$ of the coated surface. Impedance spectra were collected at different exposure times. FIG. 3 shows that the coating resistance of VCCs was steady at about $10^6$ $M\Omega cm^2$ during 120 h immersion in solution. These values of coating resistance are within the range of values commonly observed for chromium chromate coatings on 2024-T3 when tested under similar conditions. The range of $R_c$ values observed for uncoated Al alloys in this test is also shown for comparison.

Figure 4:
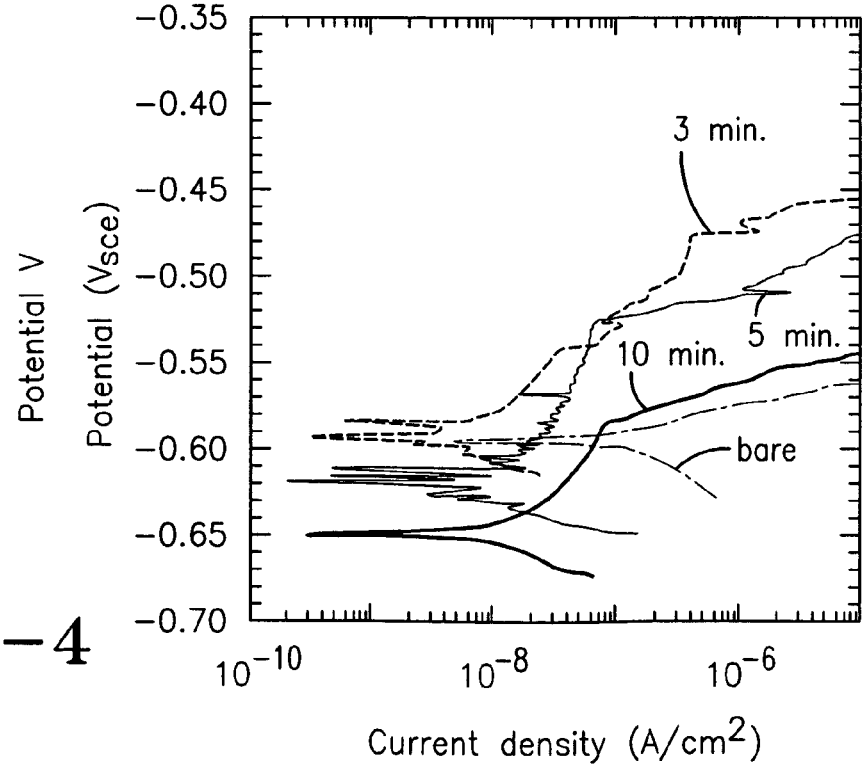
FIG. 4 illustrates anodic polarization curves for VCC coated 2024-T3 collected in aerated 0.5M NaCl. The time notations refer to the length of time the samples were immersed in the coating bath. The "bare" sample was uncoated.

FIG. 4 shows anodic polarization curves for 2024-T3 samples with VCCs formed by immersion in the coating bath for 3, 5 and 10 minutes. The curves were collected during exposure to aerated 0.5M NaCl solution. A polarization curve for uncoated 2024-T3 is shown for comparison. The uncoated alloy exhibits no passive region in this environment. However, when a VCC is present on the alloy spontaneous passivity is observed. At sufficiently positive potentials, passivity breaks down as pitting on the electrode occurs. Dispersion in pitting potential measurements has not been characterized, however this figure suggests that coatings formed by immersion in the coating bath for 3 to 5 minutes are more resistant to pitting than coatings formed by a 10 minute immersion.

Figure 5:
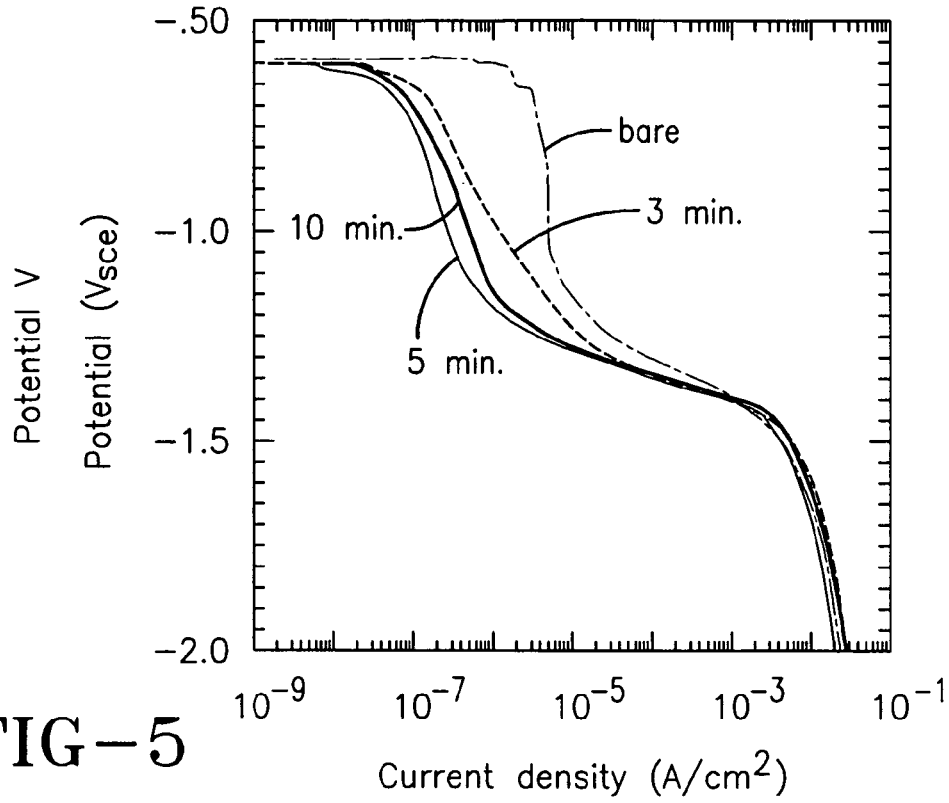
FIG. 5 illustrates cathodic polarization curves for VCC coated 2024-T3 collected in aerated 0.5M NaCl. The time notations refer to the length of time the samples were immersed in the coating bath. The "bare" sample was uncoated.

FIG. 5 shows cathodic polarization curves for 2024-T3 samples also coated for 3, 5 and 10 minutes in the VCC bath. These measurements were made during exposure to aerated 0.5M NaCl solution. In the potential region where mass transport limited oxygen reduction occurs, the limiting current density is reduced by as much as an order of magnitude compared to that of an uncoated control sample. Inhibition of oxygen reduction appears to increase as coating immersion time decreases, supporting the idea that over-coating degrades VCC corrosion protection. The form of all of the curves in FIG. 5 indicates that oxygen reduction is occurring mainly under mass transport control. One interpretation of this observation is that oxygen reduction is occurring locally on the electrode surface, and VCC formation serves to decrease the fractional area supporting this reaction.

Figure 6:
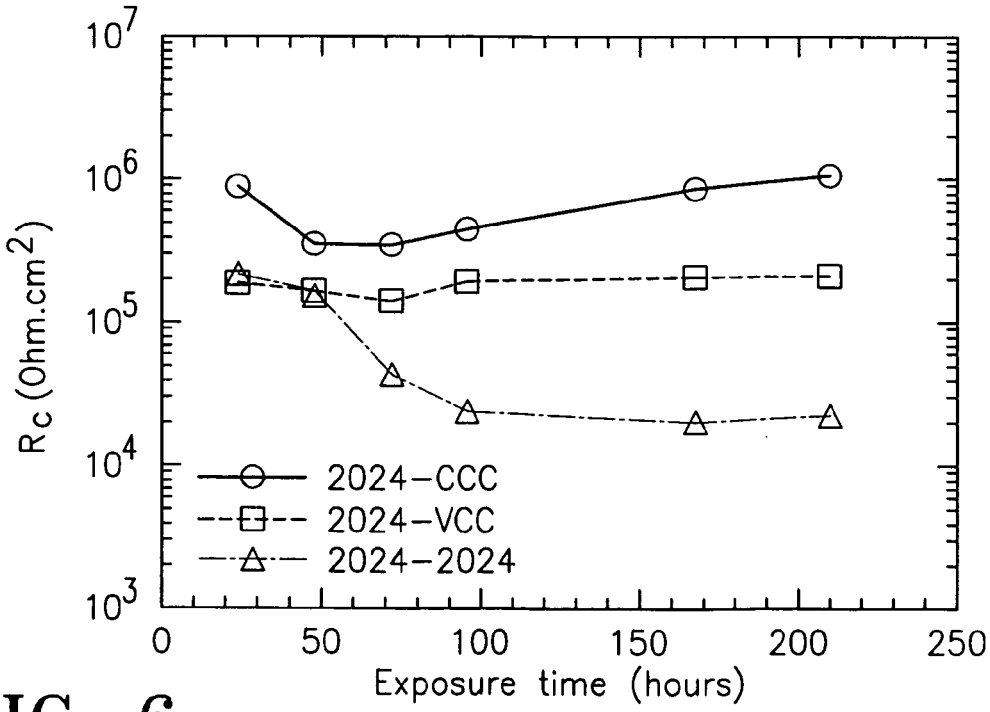
FIG. 6 illustrates the corrosion resistance of bare 2024-T3 surfaces exposed in a simulated scratch cell with VCC, CCC or uncoated 2024-T3 surfaces. Corrosion resistance is expressed as $R_c$ determined by EIS. The cells were filled with 0.1M NaCl solution. 2024-CCC refers to a cell constructed with a bare 2024-T3 surface and a chromate conversion coated 2024-T3 surface. 2024-VCC refers to a cell constructed with a bare 2024-T3 surface and a vanadate conversion coated 2024-T3 surface. 2024—2024 refers to a cell constructed with two bare 2024-T3 surfaces.

To determine if VCCs exhibit self-healing characteristics, simulated scratch cell experiments were carried out according to the methods described in Zhao et al, J. Electrochem. Soc., 145, 2258 (1998), the teachings of which are hereby incorporated by reference. In these experiments, a vanadate conversion coating was formed on 2024-T3 by immersion for 3 minutes in the coating bath. About 5 ml of 0.1M NaCl solution was introduced into the cell gap and impedance spectra were collected periodically over 200 hours to assess changes in the corrosion resistance of the uncoated side of the cell. FIG. 6 shows $R_c$ data plotted as a function of exposure time in the cells. The data show that the surface exposed in the simulated scratch cell with the VCC exhibits $R_c$ values nearly an order of magnitude greater than that of a surface exposed only to another bare surface. This result suggests that the bare surface in the simulated scratch cell has been protected from corrosion by release of vanadium from the VCC coating.

Figure 7:
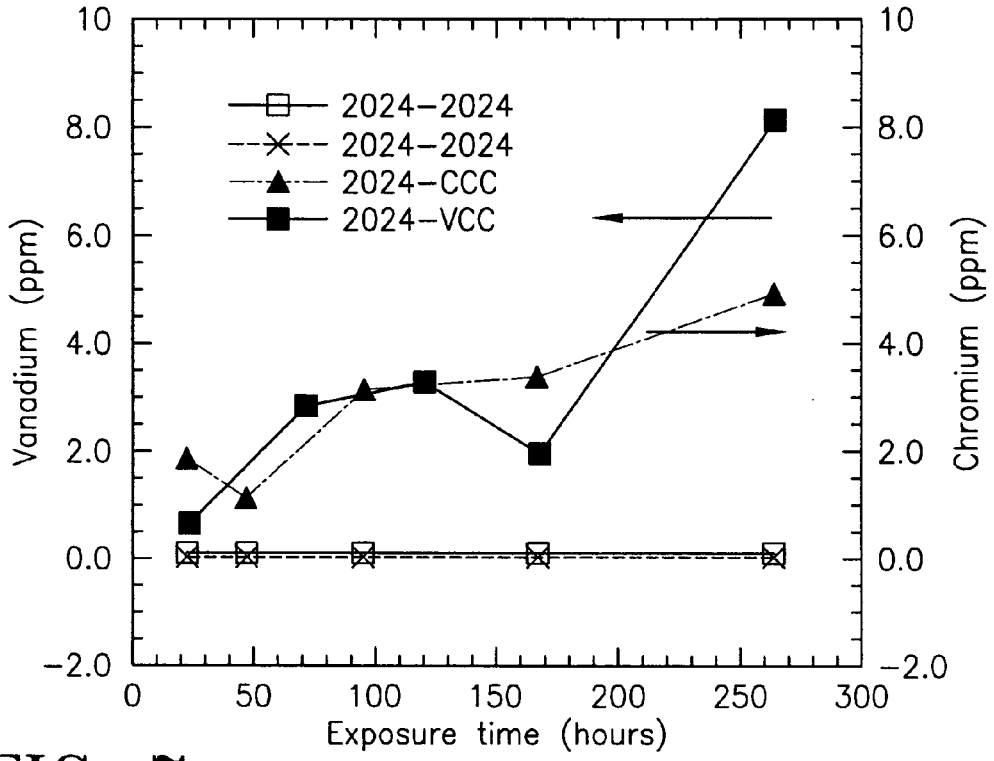
FIG. 7 shows the evolution of the vanadium and chromium concentrations in the simulated scratch cell solutions as determined by ICP-OE. 2024-CCC refers to a cell constructed with a bare 2024-T3 surface and a chromate conversion coated 2024-T3 surface. 2024-VCC refers to a cell constructed with a bare 2024-T3 surface and a vanadate conversion coated 2024-T3 surface. 2024-2024 refers to a cell constructed with two bare 2024-T3 surfaces.

As a test for vanadium release from the VCC, the composition of the solution in the cell was analyzed by inductively coupled plasma-optical emission spectroscopy (ICP-OES). Solution samples were collected from five cells at different exposure times ranging from 24 h to 264 h. Results indicate that vanadium is, in fact, released from VCCs into solution (FIG. 7), and that vanadium concentration in solution generally increases with time in amounts ranging from 0.7 to 8.2 ppm. For comparison, identical experiments were carried out in cells fabricated with a chromium chromate conversion coatings (CCC) and uncoated control surfaces. As expected, there was no detectable vanadium release in the control cell. About 1.8 ppm chromium was detected after 24 hours of simulated scratch cell exposure and 4.9 ppm Cr was detected after 264 hours of exposure in that particular experiment.

Vanadium is deposited on the bare alloy side of the simulated scratch cell indicating an interaction with the surface accounting for the increase in corrosion protection observed. The interaction of vanadium with the surface is significant enough that it can be detected by energy dispersive spectroscopy.

Figure 8:
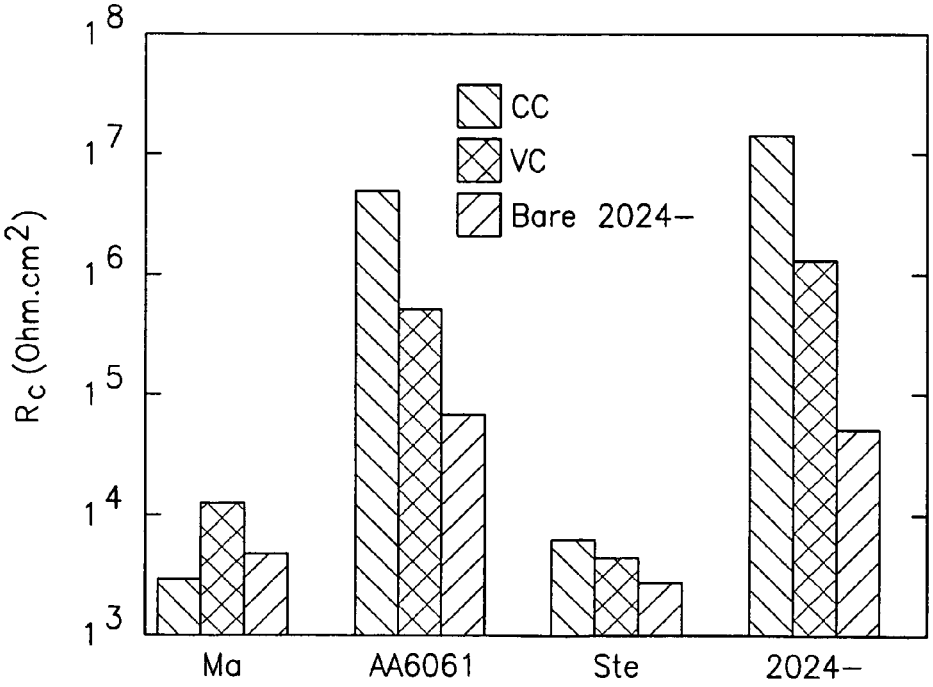
FIG. 8 shows that coating resistance values ($R_c$) for steel, magnesium and aluminum alloy substrates are increased by the VCC when compared to an uncoated alloy substrate.

Vanadium coatings that improve corrosion resistance have been formed on steel and magnesium substrates. VCCs were formed on these substrates using the preferred bath chemistry and method of application described earlier. Coated samples were exposed to aerated 0.5M NaCl solution for 24 hours and the corrosion resistance was determined by electrochemical impedance spectroscopy. FIG. 8 shows that coating resistance values ($R_c$) for steel, magnesium and aluminum alloy substrates are increased by the VCC when compared to an uncoated alloy substrate.

Vanadium coatings also have an environmental advantage. The incumbent corrosion resistant coating technology equivalent to that being proposed here is based on the used chromate compounds. Human exposure to low levels of chromates has both acute and chronic health consequences. Chromates are also known human carcinogens. Chromates are long-lived in the environment; handling and disposal of chromates generated from application and stripping of chromated paints is complex and expensive. The chemical ingredients described herein do not possess this level of toxic hazard and represent an environmentally friendly alternative to chromate coating products.

While the invention has been described in connection with what is presently considered to be the most practical and preferred embodiments, it is to be understood that the invention is not to be limited to the disclosed embodiment(s), but on the contrary, is intended to cover various modifications and equivalent arrangements included within the spirit and scope of the appended claims, which are incorporated herein by reference. Additionally, the following references are herein incorporated by reference:

1. W. Clark, R. L. McCreery, *J. Electrochem. Soc.,* (in review), (2002).
2. G. O. Ilevbare, C. Jeffcoate, J. R. Scully, Passivity and Localized Corrosion, p. 269 in Sato Symposium, PV 99-27, The Electrochemical Society, 1999.
3. G. O. Ilevbare, J. R. Scully, *J. Electrochem. Soc.,* 148, B196 (2001).
4. G. O. Ilevbare, J. R. Scully, *Corrosion,* 57, 134 (2001).
5. A. Sehgal, D. Lu, G. S. Frankel, *J. Electrochem. Soc.,* 145, 2834 (1998).
6. M. W. Kendig, R. G. Buchheit, *Corrosion* 59, 379), (2003).
7. E. Akiyama, G. S. Frankel, *J. Electrochem. Soc.,* 146, 4095 (1999).

8. H. Kaesche, Pitting Corrosion of Aluminum and Intergranular Corrosion of Al Alloys, p. 516 in Localized Corrosion, NACE, Houston, Tex., Williamsburg, Va., 1971.
9. S. T. Pride, J. R. Scully, J. L. Hudson, *J. Electrochem. Soc.,* 141, 3028 (1994).
10. L. Xia, R. L. McCreery, J. *Electrochem. Soc.,* 146, 3696 (1999).
11. A. Gallacio, F. Pearlstein, M. R. D'Ambrosio, *Met. Finish.,* 50 (1966).
12. A. L. Glass, *Mat. Protect.,* 26 (1968).
13. V. Laget, H. Isaacs, C. S. Jeffcoate, R. Buchheit, p. 173 in Proc. Electrochem. Soc., PV 99-26, The Electrochemical Society, 2000.
14. V. Laget, H. S. Isaacs, C. S. Jeffcoate, R. G. Buchheit, *ATB Metallurgie,* 40–41, 295 (2000).
15. V. N. Laget, C. S. Jeffcoate, R. G. Buchheit, H. S. Isaacs, *J. Electrochem Soc.,* 150, B425 (2003).
16. J. Zhao, G. S. Frankel, R. L. McCreery, *J. Electrochem. Soc.,* 145, 2258 (1998).
17. W. Zhang, R. G. Buchheit, *J. Electrochem Soc.,* 149, B357 (2002).
18. F. W. Eppensteiner, M. R. Jenkins, *Chromate Conversion Coatings,* 494, 1999.
19. P. L. Hagans, C. M. Haas, *Surface and Interface Anal.,* 21, 65 (1994).
20. A. Katzman, G. Malouf, R. Bauer, G. W. Stupian, *Applications of Surface Science,* 2, 416 (1979).
21. N. J. Newhard, *Metal Finishing,* 70, 69 (1972).
22. N. J. Newhard, *Metal Finishing,* 70, 66 (1972).
23. N. J. Newhard, *Metal Finishing,* 70, 49 (1972).
24. S. Wernick, R. Pinner, P. G. Sheasby, *The Surface Treatment and Finishing of Aluminum and its Alloys,* 5th ed., 220, Metals Park, Ohio, ASM International, 1987.
25. J. Osborne, *Prog. Org. Coat.,* 41, 280 (2001).
26. L. Xia, R. L. McCreery, *J. Electrochem. Soc.,* 145, 3083 (1998).
27. F. Pearlstein, M. R. D'Ambrosio, *Plating,* 55, 345 (1968).
28. S. M. Cohen, *Corrosion,* 51, 71 (1995).
29. B. W. R. Hinton, *Metal Finishing,* 89, 55 (1991).
30. B. W. R. Hinton, *Metal Finishing,* 89, 15 (1991).
31. M. W. Kendig, R. Buchheit, *Corrosion Inhibition of Al and Al Alloys by Hexavalent Cr Compounds: A Mechanistic Overview*, p. 1 in *Surface Conversion of Aluminum and Ferrous Alloys for Corrosion Resistance*, NACE International, Houston, Tex., 2000.
32. R. L. Twite, G. P. Bierwagen, *Prog. Org. Coat.,* 33, 91 (1998).
33. F. Report, *Alternatives to Chromium for Metal Finishing,* 0273RE95, National Center for Manufacturing Sciences, Ann Arbor, Mich., 1995.
34. J. T. Report, *Validation of Alternatives to Chromate Conversion Coatings for Aluminum Alloys* 2024, 6061, 7075 and Ion Vapor Deposited Aluminum on Steel, HM-R-1-1, NDCEE/CTC, Johnstown, Pa., 1997.
35. J. T. Report, *Laboratory Validation (Testing) of Alternatives to Chromate-Containing Primer Coatings for Aircraft Exterior Mold-Line Skins*, MD-R-1-1, NDCEE/CTC, Johnstown, Pa., 1998.
36. J. T. Report, *Validation of Low/No VOC and Non-Chromate Coating Systems for Support Equipment*, J-99-OC-014-R1, NDCEE, CTC, Johnstown, Pa., 2001.
37. R. G. Buchheit, S. B. Mamidipally, P. Schmutz, H. Guan, *Corrosion,* 58, 3 (2002).
38. V. Ooij, D. Zhu, G. Prasad, S. Jayaseelan, Y. Fu, N. Teredesai, *Surf. Eng.,* 16, 386–396 (2000).
39. V. Ooij, D. Zhu, *Corrosion,* 57, 413–427 (2001).
40. J. H. Osborne, K. Y. Blohowiak, S. R. Taylor, C. Hunter, G. P. Bierwagen, B. Carlson, D. Bernard, M. S. Donley, *Prog. Org. Coatings,* 41, 217–225 (2001).
41. H. E. Hager, C. J. Johnson, K. Y. Blowhowiak, C. M. Wong, J. H. Jones, S. R. Taylor, J. R. L. Cook, Chromate-free Protective Coaitngs, U.S. Pat. No. 5,866,652, 1999.
42. H. E. Hager, C. J. Johnson, K. Y. Blowhowiak, C. M. Wong, J. H. Jones, J. R. L. Cook, S. R. Taylor, Chromate-free Protective Coaitngs, U.S. Pat. No. 6,077,885, 2000.
43. K. R. Baldwin, C. J. E. Smith, P. L. Lane, Treatment of Aluminum and Aluminum Alloys, U.S. Pat. No. 5,954,893, 1999.
44. N. Das, J. P. Jandrists, Non-chrome Rinse for Phosphate Coated Ferrous Metals, U.S. Pat. No. 6,027,579, 2000.
45. M. Inoue, T. Ohnuma, T. Yamamoto, G. Sato, Liquid Rust Proof Film-forming Composition and Rust Proof Film-forming Method, U.S. Pat. No. 5,743,971, 1998.
46. M. Inoue, T. Ohnuma, T. Yamamoto, G. Sato, Method for Forming a Rust Proof Film, U.S. Pat. No. 5,938,861, 1999.
47. D. P. Buxton, P. J. Riley, Anticorrosion Treatment of Metal Coated Steel Having Coatings of Aluminium, Zinc or Alloys Thereof, U.S. Pat. No. 5,985,047, 1999.
48. P. J. Riley, Anti-corrosion Treatment of Aluminum or Aluminum Alloy Surfaces, U.S. Pat. No. 5,20,750, 1996.

What is claimed is:

1. An aqueous solution for depositing an inorganic corrosion resistant coating with self-healing properties on a metal substrate, said aqueous solution consisting essentially of:

a film-forming agent comprising at least one vanadate salt, wherein said film-forming agent forms said corrosion resistant coating at a first rate;

a supplemental soluble metal anion selected from the group consisting of ferricyanide, anions of iron, anions of molybdenum, anions of tungsten, anions of manganese, anions of boron, and anions of phosphorous, wherein said supplemental soluble metal anion accelerates said first rate thereby causing said corrosion resistant coating to form faster than said first rate; and a substrate activator, said substrate activator adapted to remove oxides on said metal substrate prior to formation of said corrosion resistant coating.

2. The aqueous solution according to claim 1 wherein said solution has a pH in the range of from about 1.0 to about 6.0.

3. The aqueous solution according to claim 1 wherein said metal substrate comprises a metal selected from the group consisting of ferrous metals and non-ferrous metals.

4. The aqueous solution according to claim 1 wherein said metal substrate comprises a metal selected from the group consisting of aluminum, iron, zinc, magnesium, cadmium, and alloys thereof.

5. The aqueous solution according to claim 1 wherein said film-forming agent is present in a concentration of from about 5 to about 150 mM.

6. The aqueous solution according to claim 1 wherein said supplemental soluble metal anion is present in a concentration of from about 1 to about 75 mM.

7. The aqueous solution according to claim 1 wherein said substrate activator is selected from the group consisting of chloride salts and fluoride salts.

8. The aqueous solution according to claim 1 wherein said substrate activator is present in a concentration of from about 1 to about 50 mM.

9. A metal object coated with the aqueous solution of claim 1.

10. The metal object according to claim 9 wherein said aqueous solution is applied to said metal object by a process selected from the group consisting of immersion of said metal object in a bath of said aqueous solution, spraying said aqueous solution on said metal object, and rolling said aqueous solution on said metal object.

11. An aqueous solution for depositing an inorganic corrosion resistant coating with self-healing properties on a metal substrate, said aqueous solution consisting essentially of:

a film-forming agent comprising at least one vanadate salt, wherein said film-forming agent forms said corrosion resistant coating at a first rate;

a supplemental soluble metal anion, wherein said supplemental soluble metal anion accelerates said first rate thereby causing said corrosion resistant coating to form faster than said first rate; and a substrate activator selected from the group consisting of chloride salts and fluoride salts, said substrate activator adapted to remove oxides on said metal substrate prior to formation of said corrosion resistant coating.

12. The aqueous solution according to claim 11 wherein said solution has a pH in the range of 1mm about 1.0 to about 6.0.

13. The aqueous solution according to claim 11 wherein said metal substrate comprises a metal selected from the group consisting of ferrous metals and non-ferrous metals.

14. The aqueous solution according to claim 11 wherein said metal substrate comprises a metal selected from the group consisting of aluminum, iron, zinc, magnesium, cadmium, and alloys thereof.

15. The aqueous solution according to claim 11 wherein said film-forming agent is present in a concentration of from about 5 to about 150 mM.

16. The aqueous solution according to claim 11 wherein said supplemental soluble metal anion is present in a concentration of from about 1 to about 75 mM.

17. The aqueous solution according to claim 11 wherein said substrate activator is present in a concentration of from about 1 to about 50 mM.

18. A metal object coated with the aqueous solution of claim 11.

19. The metal object according to claim 18 wherein said aqueous solution is applied to said metal object by a process selected from the group consisting of immersion of said metal object in a bath of said aqueous solution, spraying said aqueous solution on said metal object, and rolling said aqueous solution on said metal object.

* * * * *

UNITED STATES PATENT AND TRADEMARK OFFICE

CERTIFICATE OF CORRECTION

PATENT NO. : 7,135,075 B2
APPLICATION NO. : 10/761077
DATED : November 14, 2006
INVENTOR(S) : Buchheit et al.

It is certified that error appears in the above-identified patent and that said Letters Patent is hereby corrected as shown below:

On The Title page, Item (56), U.S. PATENT DOCUMENTS, Please delete, "6,692,583 B1" and insert --6,692,583 B2--.

In column 11, lines 22-24, please delete "12, The aqueous solution according to claim 11 wherein said solution has pH in the range of 1mm about 1.0 to about 6.0." and insert -- 12. The aqueous solution according to claim 11 wherein said solution has a pH in the range of from about 1.0 to about 6.0. --

Signed and Sealed this

Twenty-sixth Day of June, 2007

JON W. DUDAS
*Director of the United States Patent and Trademark Office*